United States Patent [19]

Rodney

[11] 4,363,311

[45] Dec. 14, 1982

[54] GOLF BALL DRIVING DEVICE

[76] Inventor: Peter W. Rodney, 66 Elmcrest Rd., Etobicoke, Ontario, Canada, M9C 3R9

[21] Appl. No.: 297,153

[22] Filed: Aug. 28, 1981

[51] Int. Cl.[3] ..... F41B 7/00; A63B 53/00

[52] U.S. Cl. ..... 124/16; 124/36; 273/77 R

[58] Field of Search ..... 124/7, 16, 35 R, 36, 124/40, 41 R; 273/26 D, 77 R, 129 V, 129 AP, 129 S, 129 T; 73/13

[56] References Cited

U.S. PATENT DOCUMENTS

| | | | |
|---|---|---|---|
| 1,618,638 | 2/1927 | Coles | 273/77 R |
| 1,863,035 | 6/1932 | Stuart | 124/16 |
| 2,577,186 | 12/1951 | Florer | 124/16 |
| 2,719,716 | 10/1955 | Sawtelle | 124/16 X |

*Primary Examiner*—George J. Marlo
*Attorney, Agent, or Firm*—Donald E. Hewson

[57] ABSTRACT

A golf ball driving device is disclosed, being a device which is mounted on wheels for easy maneuverability, and having generally an operating and transport handle, and a trigger release handle. The operating handle has a cam and ratchet at its lower end, for driving a ratchet bar against a compression spring (or pneumatic cylinder) to create compression force. The trigger release handle has a follower arm which latches against the ratchet bar, and it is moveable to release the ratchet bar and thereby to release the compression force. A striker plate moves forwardly and downwardly upon release of the compression, to strike a golf ball when in place. The striker plate is rotatably adjustable so that its angle and point of impact against a golf ball may be adjusted.

14 Claims, 7 Drawing Figures

FIG.1
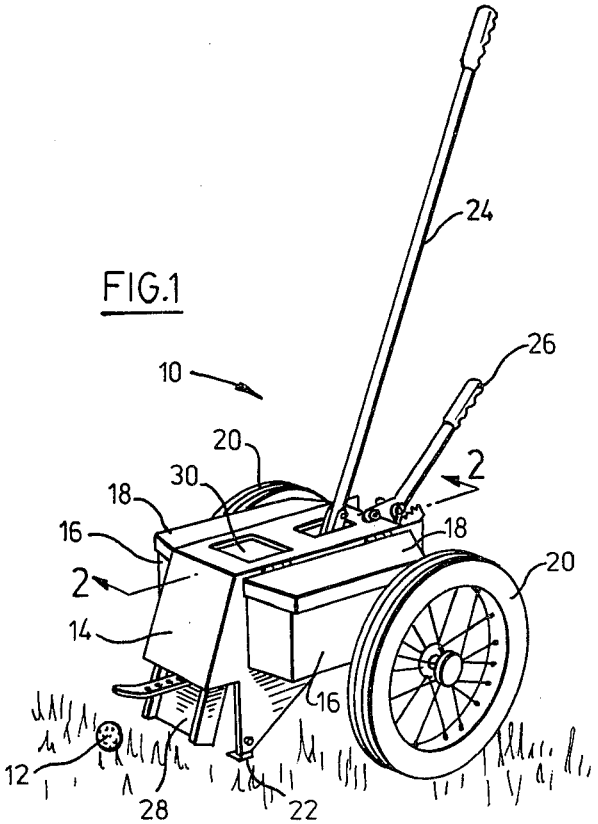
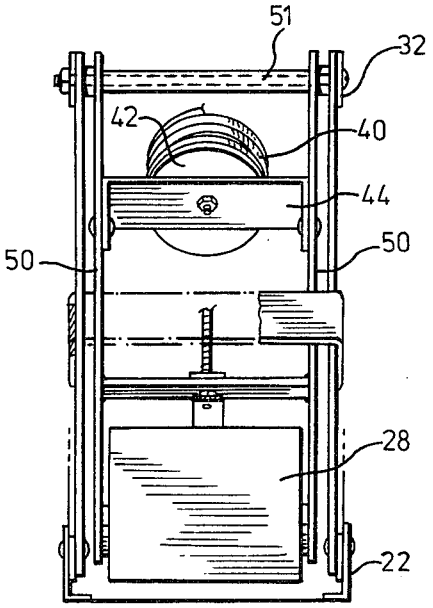
FIG.3

GOLF BALL DRIVING DEVICE

FIELD OF THE INVENTION

This invention relates to a golf ball driving device, and particularly a compression operated device whose striking force comes from the release of stored energy. More specifically, the present invention relates to a golf ball driving device which can be manoeuvreed around an ordinary golf course, duplicating all or nearly all golf strokes normally taken during any normal play of that game.

BACKGROUND OF THE INVENTION

As is well known, the usual manner of playing the game of golf is with a variety of clubs, both woods and irons, and a putter. Very often, players—at least those of more advanced ranking—may carry special purpose clubs, so that the number of clubs being carried by a player, especially an advanced player, becomes considerable. So, also, the cost of acquiring and maintaining such a collection of clubs becomes considerable; and, of course, the weight of such a large collection of clubs becomes greater.

There are certain persons who, for a variety of reasons, may wish to partake of the exercise, fresh air, good weather and companionship that a golf game may usually afford, but for a variety of reasons can not or are not able to do so. Such persons may include physically handicapped persons of all kinds, as well as persons of advanced age who have not before learned to play the game of golf.

Moreover, there may be skilled players or novice players who wish for a different challenge in respect to their game, or who are becoming less capable of carrying a heavy load of golf clubs during a game, but for whom riding in an electric golf cart or hiring a caddy may not be acceptable.

In any event, the present invention seeks to provide a novel golf ball driving device for use by skilled or unskilled players, on regulation or championship courses as well as shorter courses. However, although as will be understood hereafter, the present invention will duplicate virtually all kinds of golf shots required during a normal or even extremely difficult game of golf, if is not generally supposed that the device of the present invention would be used on a putting green—where normally the rules preclude any machine or other device on the green except a putter. That is to say, the present invention provides a golf ball driving device which will duplicate tee shots, shots from the rough, approach shots, etc.; and is particularly useful in making shots from beneath low hanging trees, which shots are otherwise quite difficult to make. Moreover, the present invention provides a device which is sufficiently adjustable that the range and trajectory of the golf ball, for each shot taken, may be closely controlled and duplicated from shot to shot.

There have been a number of golf ball driving devices taught in the prior art, and other devices for miniature golf games and the like; and there are a number of spring operated catapults or throwing devices which are more particularly designed for use in throwing baseballs or footballs.

For example, one of the earlier known golf ball driving devices is that which is taught in U.S. Pat. No. 2,477,308 issued Jul. 26, 1949 by W. A. MALKAN. That device, however, is a quite cumbersome device, requiring the use of both hands and at least one foot in steadying and operating it. Essentially, the MALKAN device is one which has a reciprocating plunger driving a rack and in turn a rotatable gear to which an arm having an adjustable driving head with a pair of striking faces, is secured. The force of the striking motion of the striking head against a golf ball is determined by the force by which the plunger is manually operated, all of which may require a certain physical distortion and discomfort to the operator.

R. E. LEE, in U.S. Pat. No. 3,410,258 issued Nov. 12, 1968, provides a centrifugal ball propelling device which takes several different forms or embodiments, but which requires the operation of a plunger to affect the distance and trajectory of the ball when it is "thrown" from the device.

H. E. LIPPERT, has provided a variety of types of apparatus, mainly spring loaded, intended for playing miniature golf, whereby the player sights a device which has the appearance of a gun in the direction of intended play. Such devices are taught in his U.S. Pat. Nos. 3,469,846, dated Sep. 30, 1969; and three patents issued Aug. 10, 1971, Nos. 3,598,411, . . 2, and . . 3.

Several other spring loaded ball throwing or catapult machines include DIXON, U.S. Pat. No. 3,951,125, issued Apr. 20, 1976, which shows a device intended for throwing footballs; PERRY, U.S. Pat. No. 4,082,076, issued Apr. 4, 1978, which provides a spring loaded device for pitching a baseball; and a toy catapult device shown in HASHIMOTO, U.S. Pat. No. 4,111,179, issued Sep. 5, 1978.

The latter patent, HASHIMOTO, shows a vertically moving pivot arm which has a plurality of notches on its underside, the notches being adapted to accommodate an elastic band mounted in a yoke, at a variety of heights, so as to effect the catapulting force and therefore the range of the projectile to be thrown by the toy.

None of the above prior art, however, teaches a device of the present nature, which is specifically intended for duplicating the variety of golf shots normally taken during an ordinary round of golf on a standard golf course; including tee shots which may have a range of up to three hundred yards, and approach shots which may have a range of only ten or twenty yards. As well, the present invention provides a device by which the trajectory of the ball may be varied, so as to shoot uphill or downhill, or over a hedge or other obstacle, etc.

Accordingly, the present invention provides a golf ball driving device which has a frame and wheels mounted to the frame, and at least one support means for the frame when the device is at rest. The golf ball driving device has compression means, means for compressing the compression means, and means for releasing the compression means. A striker plate is provided, in such a manner that the motion of the striker plate generally describes a downwardly and forwardly directed arc, the lowest point of that arcuate motion being at a position when the compression means has its least compression. According to the present invention, a driving ratchet and cam are associated with a driveable ratchet bar, for compressing the compression means; and are moveable out of engagement with the ratchet bar when required. The means for releasing the compression means—the trigger—has a follower arm in contact with the ratchet bar, and which is disengageable therefrom. Handle means, such as a lever arm, are provided for driving the cam and ratchet means so as to compress the compression means; and other lever arm or handle means are provided for moving the follower arm out of contact with the ratchet bar.

Thus, the present invention provides a golf ball driving device which is of relatively simple manufacture and assembly, and inexpensive in cost.

Further, the present invention provides a device of quite reasonable appearance, to which may be appended storage means for carrying golf balls and tees, and other golf-related accessories, refreshments and the like.

Still further, the present invention provides a golf ball driving device which essentially duplicates all normal golf strokes; but it is recognized that the device of the present invention would not normally be used for putting strokes because of a general prohibition against the use of such devices on the greens of most golf courses.

Still further, the present invention has an object of providing all of the above in such a manner that considerable sporting challenge is still maintained, consistent with the purposes of the game of golf, but by which less damage to a course occurs because unintentional divots are not taken.

Moreover, by using a device of the present invention, the player can generally shorten the amount of time taken, because of consistency and therefore a lessened chance of loosing balls due to inadvertent slicing or hooking, and because less time is taken for each tee or fairway stroke because the device can be cocked and ready to take the stroke while the player is waiting for another player to make his stroke.

BRIEF DESCRIPTION OF THE DRAWINGS

These and all other features and objects of the invention are more clearly described hereafter, in association with the accompanying drawings, in which:

FIG. 1 is a general perspective view of a device according to the present invention;

FIG. 3 is a cross-sectional view of the front of the device, taken in the directions of arrows 3—3 in FIG. 2;

DESCRIPTION OF THE PREFERRED EMBODIMENTS

Figure 2:
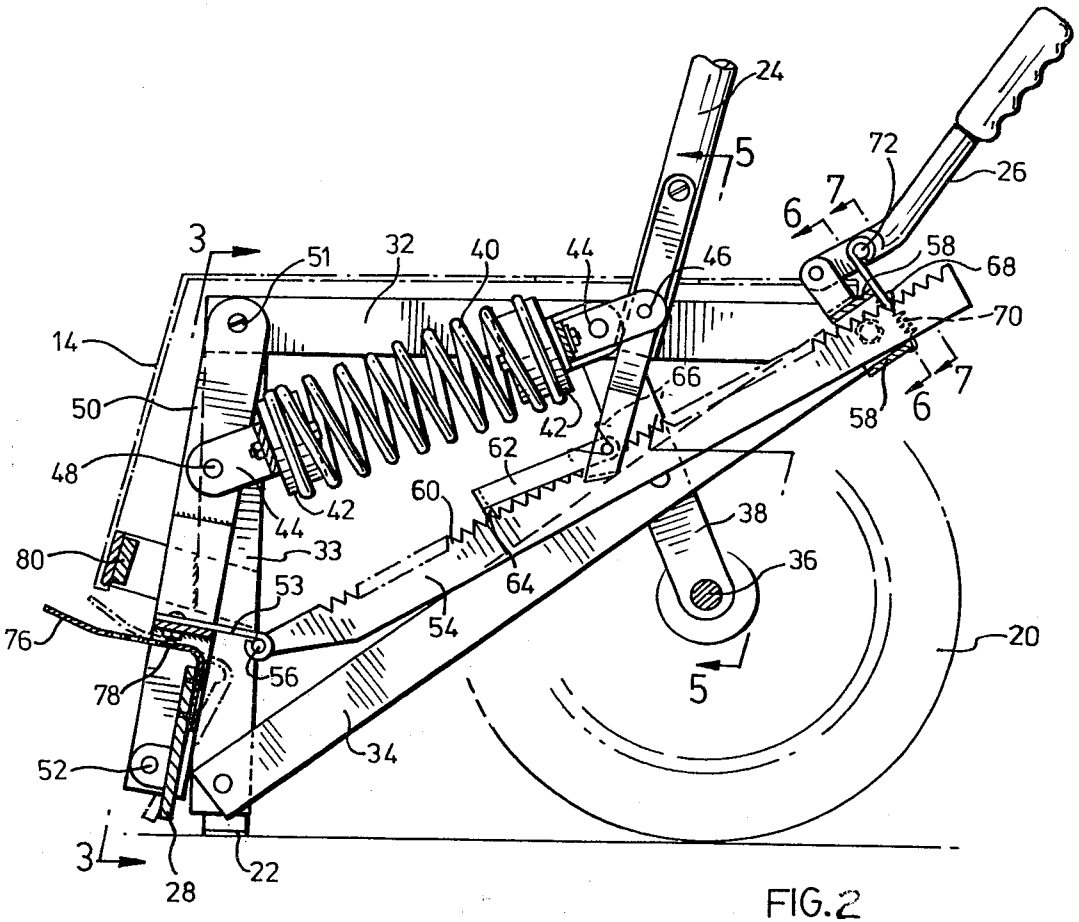
FIG. 2 is a cross-sectional view taken in the direction of arrows 2—2 in FIG. 1.

The golf ball driving device of the present invention is shown generally at 10 in FIG. 1, and in that Figure the device 10 is shown behind but not yet in driving relationship to a golf ball 12. As will be seen from the description that follows, the golf ball 12 may be placed on a tee or played from the fairway—or, indeed, from sand or pebble—just as it would be and according to the general rules of the game of golf. The working mechanism of the device is within the body portion or carbinet 14; and in the device shown, two pockets or receptacles 16 are shown, each having a hinged lid 18, one on either side of the device. Golf balls and tees, other accessories, refreshments, etc., may be kept in the receptacles 16.

The device has a pair of wheels 20, one at either side, and when at rest there is at least one and generally a pair of supports 22, one at either side of the body portion 14. The support 22 may comprise a small plate as shown, or a spur which may extend downwardly into the ground for a short distance.

As seen in FIG. 1, there are two handles for the device, designated at 24 and 26. The handle 24 serves two purposes, both as an operating handle whereby the compression means within the device is compressed, and as a manoeuvreing or transport handle by which the device is moved from place to place. Obviously, it is a simple matter to tilt the handle 24 backwards beyond its own limit of travel, so that the device lifts off its supports 22 at the front end, whereby it is then moveable on its wheels 20. Lining the device up behind a golf ball 12 is a simple matter; and when the striker plate shown generally at 28 is in its cocked position as described hereafter, particularly with reference to FIG. 4, the exact positioning of the device 10 to the ball 12 may be determined by looking downward through a sighting opening 30 in the top of the body portion 14.

Turning now to FIG. 2, the principal operating components of a golf ball driving device according to the present invention are shown, in an unstressed or rest position. Generally, the device comprises a pair of upper frame members 32, one at each side, and a pair of lower frame members 34. The wheels 20 are conveniently mounted for rotation about an axle 36, supported by a pair of frame members 38.

The front support 22 is found at the bottom of a front frame member 33; so that, in general, the frame of the golf ball driving device of the present invention comprises members 32, 33 and 34 on each side.

Within the housing 14, there is a compression means 40, normally a spring which is shown to be a coil spring, and which may comprise a pair of coil springs, or alternatively the compression means may comprises a pneumatic cylinder. Conveniently, the spring 40 has a pair of end plates 42, to which are secured a pair of mounting brackets 44. The top mounting brackets 44 are secured at 46 which is an axle about which the top of the spring 40 is thereby rotatably mounted. As will be seen hereafter, the handle 24 is also rotatably mounted at the axle 46; and by that means, each of the springs 40 and the handle 24 are rotatably mounted or secured to the frame of the golf ball driving device.

The lower bracket 44 of the spring 40 is pivotally mounted at 48 to a striker arm 50. Conveniently, the striker arm 50 comprises a pair of such arms, as indicated in FIG. 3. The striker arm 50 is pivotably secured to the upper frame member 32 at 51, so that an axle 51 extends between the two upper frame members 32 at each side of the body of the device, with the pair of arms 50 pivotably mounted thereto.

In any event, it is seen that the striker plate 28 is pivotably secured at 52 to the bottom end of the striker arm 50. Moreover, a bracket 53 is provided, to which a ratchet arm 54 described in greater detail hereafter is pivotably secured at 56.

The ratchet bar 54 is, as noted, secured at its bottom end to the striker bar 50 by bracket 53, at 56. The upper end of the ratchet bar 54 moves freely through a pair of box members 58, secured at the rear ends of the upper frame members 32. (See FIGS. 6 and 7.) The upper side of the ratchet bar 54 has a sawtooth configuration formed in it, as at 60; and the sawtooth configuration extends substantially along the entire upper length of the ratchet bar 54.

A cam 62 and ratchet 64 are adapted to the bottom end of the operating handle 24, which comprises a lever arm rotatably mounted to the frame of the device at 46. The cam 62 is forced downwardly towards the ratchet bar 54 by a spring 66, so that the ratchet 64 normally maintains contact in any one of the notches in the sawtooth 60. The shape and positioning of the ratchet 64 with respect to the ratchet bar 54 are such that, when the operating arm is moved forward (to the left in FIG. 2) the ratchet 64 engages with one of the sawteeth 60 of the ratchet bar 64, causing the ratchet bar to move upwardly to the right, through the box frames members 58. In so doing, the striker arm 50 is pulled backwardly, and the spring 40 is compressed. A number of such operations may be conducted, according to the compression of the spring 40 as may be determined, and discussed in greater detail hereafter. Obviously, on each return stroke of the operating handle 24 rearwards—to the right as shown in FIG. 2—the ratchet 64 sides upwards over each succeeding sawtooth 60, until the backward motion of the operating arm 24 stops or until the cam 62 lifts away from the ratchet bar 54 as discussed hereafter.

Also associated with the box members 58 through which the rear upper end of ratchet bar 54 is free to move, is a follower arm 68 which contacts the sawteeth 60. The follower arm 68 may act by gravity against the ratchet bar 54, or it may be biassed by a spring 70. The follower arm 68 is pivotably mounted at 72 to the rearmost handle or arm 26.

As the ratchet bar 54 is moved rearwardly by operation of the operating handle 24, thereby compressing the spring 40, the follower arm 58 engages with succeeding sawteeth 60, and is held against them by gravity, or is spring biassed tension against them by the spring 70.

Obviously, as the compression in the spring 40 increases, its tendency to expand to its original position increases, thereby creating a locking tendency of the follower arm 68 in one of the spaces between the sawteeth 60 of the ratchet bar 54, against the backside of the box member 58. Thus, the compression of the spring 40 maintains the follower arm 68 in locked position.

It is evident, therefore, that the follower arm 68 and handle 26 function together as a trigger or release for the golf ball driving device of the present invention, so that release of the driving force of the device may be determined upon movement of the handle 26.

However, before the triggering action by release of the follower arm 68 can occur, it is necessary to disengage the ratchet 64 from the ratchet bar 54. This is accomplished by further backwards motion of the handle 24, more specifically as indicated in FIG. 4.

Figure 4:
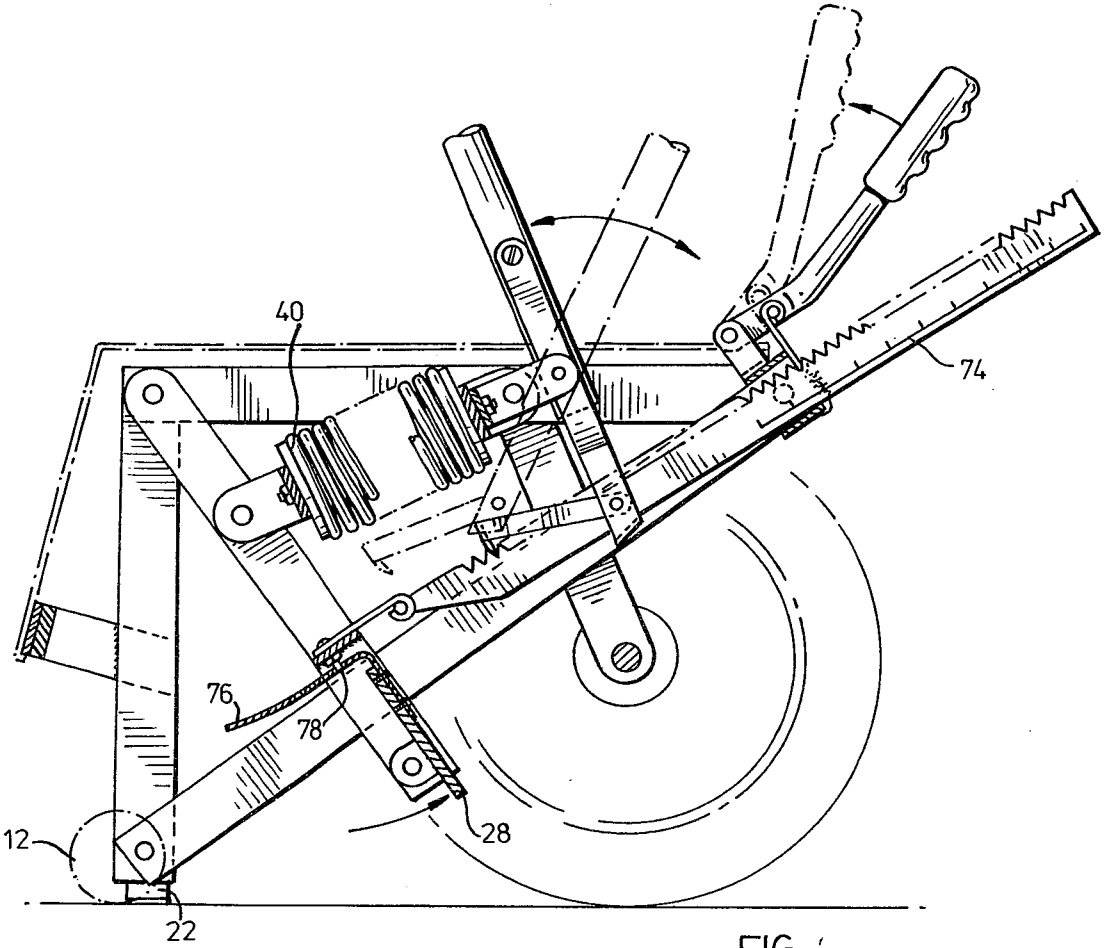
FIG. 4 is a view similar to FIG. 2, but showing the device in a cocked position ready to make a stroke.

Referring also to FIGS. 3 and 4, as well as FIG. 2, it is now seen that operation of the golf ball driving device is very simple, requiring first a compressing of the spring 40 by way of operation of the handle 24, followed by disengagement of the driving ratchet 64 from the ratchet bar 54, and thereafter followed by disengagement of the follower arm 68 from the ratchet bar 54, which constitutes a triggering action for operation of the device.

In general, the device 10 is placed substantially in position before the compression means 40 is cocked by operation of the handle 24. Thus, during movement of the device 10 by manoeuvering the same using handle 24, the compression means is uncompressed; thereby saving unnecessary wear and tear on the device, as well as being more safe for the operator or his playing companions.

The golf ball 12 is normally located between the support members 22, and may be more or less forward of a line drawn between the members 22, depending upon the stroke to be taken and the intended range and trajectory of the ball 12 as it is driven. The range is determined by the amount of compression of the spring 40, which may be indicated on a scale conveniently placed on the ratchet bar 54 at 74. Obviously, the more compression there is in the spring 40, the greater will be the impact of the striker plate 28 against the ball 12, and the greater the range.

The trajectory of the ball 12 is a function of the force by which it is hit, but it is also a function of the angle at which impact against the ball 12 is made by the striker plate 28. Thus, the striker plate 28 is pivotably mounted at 52 to the striker arm 50, in such a manner that as the angle of the striker plate 28 is increased with respect to the vertical when at rest, as indicated in chain-line in FIG. 2, the point at which the striker plate will impact the ball 12 becomes lower, and the face of the striker plate 28 is less steeply inclined to the ground. This is the same as the face of various golf clubs, both woods and irons, where the face of a 2-iron, for example, is considerably more vertical than the face of, say, a 9-iron. Likewise, the face of a driver or 1-wood is considerably more vertical than the face of a 4-wood.

It is desireable, however, to fix the striker plate 28 in place for any given stroke which is about to be taken. For that purpose, therefore, a striker plate adjustment arm 76 is provided, which may co-operate with a stud 78, to lock the rotatable adjustment of the striker plate 28 in any given position. That co-operation is generally by means of a number of holes which are formed through the striker plate adjustment arm 76, through any of which the stud 78 may extend. Obviously, the striker plate adjustment arm 76 has a springiness to assure a secure co-operation with the stud 78, as indicated by chain-line in FIG. 2.

Also, it is clear that the axis about which the rotatable adjustment of the striker plate 28 is accomplished is an axis which is perpendicular to the direction of movement of the striker plate. Moreover, since the striker plate is located at the bottom of the striker arms 50, upon release of the compression force in the spring 40, it is clear that the movement of the striker plate 28 is such that it describes an arc. Further, the lowest portion of that arc is at a position when the compression in the spring 40 is at its lowest point—generally nil.

The forward motion of the striker arms 50 carries the striker plate 28 through the rest position of the ball 12, thereby providing followthrough for proper guidance of the ball following impact. However, it is not necessary for there to be very much followthrough, and a shock absorber 80 is provided to stop the forward motion of the striker arm 50 and to absorb some of the energy of that forward motion. Other of the energy of the forward motion is absorbed by the spring 40, which by now is in tension, and restoration of the striker arm 50 and the compression components including the ratchet bar 54 to their rest position, is thereby assured.

Figure 5:
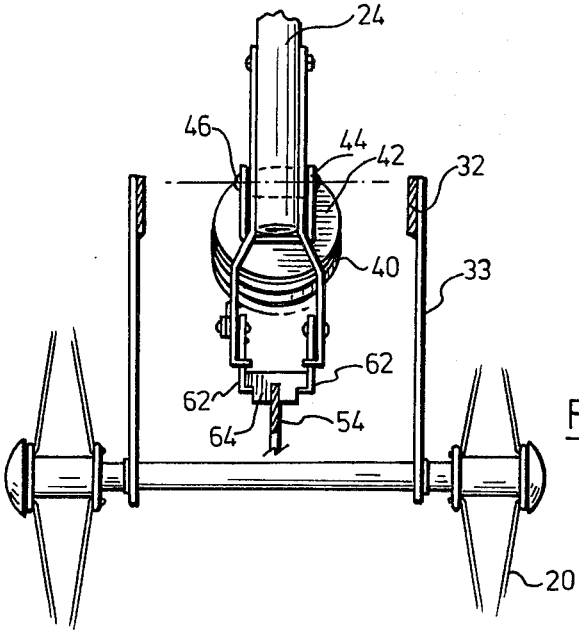
FIG. 5 is a cross-sectional view, looking forward on the lines 5—5 in FIG. 2.
Figure 6:
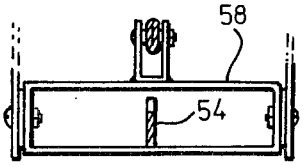
FIG. 6 is a partial view in the direction of arrows 6—6 in FIG. 2.
Figure 7:
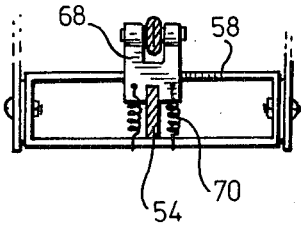
FIG. 7 is similar to FIG. 6 but taken on the line 7—7 in FIG. 2, behind the position of FIG. 6.

FIGS. 5, 6 and 7 are provided to demonstrate the relationship of the ratchet bar 54 to the frame and to the box members 58. Thus, for example, it may be seen that the drive cam 62 generally comprises a pair of arms, between which the ratchet member 64 is located. Also, the relationship of the follower arm 68 to the box member 58 is shown in FIG. 7; and from FIGS. 6 and 7, it is clear that the ratchet bar 54 is unhindered except for the follower arm 68 in either backward or forward motion relative to the box member 58.

A golf ball driving device has been described, which has sufficient adjustability both as to the compression in the spring means and the angle of impact of the striker plate against the ball, so that the range and trajectory of the golf ball when driven, can be controlled. Moreover, it is evident that because of the placement of the striker plate within the device, there is no unnecessary and damaging taking of divots from the fairway as a golf ball is being driven. It is also apparent that the height of the point of impact can be determined and adjusted, so that the point of impact on a tee shot would be considerably different than the point of impact on a simple approach shot or a shot taken from a sand trap. Moreover, the force of the impact is controlled.

Obviously, the golf ball driving device of the present invention can be adjusted as to the compression of the spring before the player is allowed to take his shot, thereby saving time. Moreover, since the golf ball driving device of the present invention will neither slice nor hook a golf ball upon impact, less time for play should be taken, because less time would be spent looking for an otherwise lost ball.

The materials of which the present invention may be made include steel and aluminum, or plastic sheeting for the housing, so that assembly of the golf ball driving device of the present invention is easily and inexpensively accomplished.

As mentioned, the compression spring 40 may comprise a pair of springs, or a pneumatic cylinder. The triggering arrangement of the follower arm against the ratchet bar may be gravity located, especially in view of the spring force of the spring when in compression.

Other features and alterations to the invention may also be made, without departing from the spirit and scope of the appended claims.

What is claimed is:

1. A golf ball driving device having a frame, wheels secured to said frame for mobility of said device, and at least one support means for said frame when said device is at rest; and having:

compression means for storing compressed energy;

means for compressing said compression means;

means for releasing the compression of said compression means;

striker plate means associated with said compression means and adapted for forward motion in such a manner that the path of said striker plate generally describes a downwardly and forwardly directed arc, the lowest point of the arcuate movement of said striker plate so defined being at a position when said compression means has its least compression;

said means for compressing said compression means being a driving ratchet on a cam associated with a moveable and drivable ratchet bar; said driving ratchet and cam being moveable to a position where said driving ratchet is out of engagement with said ratchet bar;

said means for releasing the compression of said compression means being a follower arm in contact with said ratchet bar; said followr arm being disengageable from said ratchet bar; and, first handle means for driving said cam and ratchet means so as to compress said compressor means; and second handle means for moving said follower arm out of contact with said ratchet bar.

2. The device of claim 1, where said compression means has two ends and is secured at one end to said frame and at the other end to a striker arm; said striker arm being pivotably secured to said frame above that end of said compression means which is secured to said striker arm; said ratchet bar being in pivotable relationship to said striker arm at the end of said ratchet bar remote from said follower arm;

said striker plate being rotatably mounted to said striker arm for rotatable adjustment on an axis perpendicular to said striker arm.

3. The device of claim 2, where said striker arm comprises a pair of arms, one at each side of said frame, and said striker plate is rotatably mounted between said pair of arms.

4. The device of claim 3, where said compression means is a compression spring.

5. The device of claim 3, where said compression means is a pneumatic cylinder.

6. The device of claim 3, where said follower arm is spring biassed against said ratchet bar.

7. The device of claim 4, where said first handle means is a pivotable lever arm pivotably secured to said frame, and having sufficient movement so as to be able to lift said cam and ratchet out of engagement with said ratchet bar.

8. The device of claim 7, where said compression means is secured to said frame on the same axis that said pivotable lever arm is pivotably secured to said frame.

9. The device of claim 7, where said pivotable lever arm is sufficiently long as to allow the operator of said device to maneouver said device by using said lever arm as an operating handle therefor.

10. The device of claim 4, 6 or 7, where said second handle means is a trigger release handle pivotably secured to said frame, and said follower arm is pivotably secured to said trigger release handle.

11. The device of claim 6, where said second handle means is a trigger release handle pivotably secured to said frame, and said follower arm is pivotably secured to said trigger release handle; and the spring means causing said spring biassing force of said follower arm against said ratchet bar is secured thereto at one end thereof, and secured to said frame at the other end thereof.

12. The device of claim 2, 3, or 4, where the rotatable adjustment of said striker plate is accomplished by a striker plate adjustment arm which is secured thereto, and which is lockable in any one of a plurality of positions for different rotatable adjustment positions of said striker plate.

13. The device of claim 2, 3, or 4, where the rotatable adjustment of said striker plate is accomplished by a striker plate adjustment arm which is secured thereto, and which is lockable in any one of a plurality of positions for different rotatable adjustment positions of said striker plate; and where said striker plate is mounted on a pivot such that adjustment of the striker plate at increasingly greater angles to its most vertical position lowers the point on said striker plate which will have initial impact with a golf ball.

14. The device of claim 2, 4 or 7, where said follower arm is located behind a frame member placed transversely thereof, so that when said compression means is under compression, a force is created between the follower arm and that portion of the ratchet bar with which said follower arm is engaged, against said transverse frame member.

* * * * *